US010531741B2

(12) United States Patent
Rajkiewicz et al.

(10) Patent No.: US 10,531,741 B2
(45) Date of Patent: Jan. 14, 2020

(54) SEATING DEVICE HAVING A SUPPORT MEMBER

(71) Applicant: AmTab Manufacturing Corporation, Aurora, IL (US)

(72) Inventors: Gregory Rajkiewicz, Elk Grove Village, IL (US); Doss Samikkannu, Des Plaines, IL (US); Jeremias C. Rivera, Jr., Elmhurst, IL (US)

(73) Assignee: AMTAB MANUFACTURING CORPORATION, Bensenville, IL (US)

( * ) Notice: Subject to any disclaimer, the term of this patent is extended or adjusted under 35 U.S.C. 154(b) by 32 days.

(21) Appl. No.: 15/721,270

(22) Filed: Sep. 29, 2017

(65) Prior Publication Data

US 2019/0098999 A1 Apr. 4, 2019

(51) Int. Cl.

| | |
|---|---|
| ***A47B 3/00*** | (2006.01) |
| ***A47C 7/00*** | (2006.01) |
| ***A47B 3/14*** | (2006.01) |

(52) U.S. Cl.

CPC ..... *A47C 7/004* (2013.01); *A47B 3/14* (2013.01); *A47C 7/006* (2013.01); *A47B 2003/145* (2013.01)

(58) Field of Classification Search

CPC ..... A47B 3/14; A47B 2003/145; A47B 83/02
See application file for complete search history.

(56) References Cited

U.S. PATENT DOCUMENTS

| | | | | |
|---|---|---|---|---|
| 6,065,802 | A * | 5/2000 | Bue | A47B 3/14 108/168 |
| 6,386,628 | B2 * | 5/2002 | Bue | A47B 3/14 108/168 |
| 7,393,049 | B2 * | 7/2008 | Chase | A47C 9/022 297/134 |
| 7,758,113 | B2 * | 7/2010 | Hanusiak | A47C 9/10 297/134 |
| 8,181,583 | B2 | 5/2012 | Rivera, Jr. et al. | |
| 8,182,032 | B2 * | 5/2012 | Dickey | A47B 3/14 297/157.1 |
| 8,205,937 | B2 | 6/2012 | Rivera, Jr. et al. | |
| 8,479,667 | B2 | 7/2013 | Rivera, Jr. et al. | |
| 8,820,826 | B2 * | 9/2014 | Dickey | A47B 3/14 297/121 |
| 9,101,218 | B2 * | 8/2015 | Bradley | A47B 3/14 |
| D763,029 | S | 8/2016 | Dickey | |
| 10,039,382 | B2 * | 8/2018 | Dickey | A47C 7/16 |
| 2011/0057483 | A1 * | 3/2011 | Dickey | A47B 3/14 297/124 |
| 2013/0313868 | A1 * | 11/2013 | Dickey | A47B 3/14 297/135 |
| 2016/0302576 | A1 | 10/2016 | Dickey | |

* cited by examiner

*Primary Examiner* — Shin H Kim
(74) *Attorney, Agent, or Firm* — Barnes & Thornburg LLP

(57) ABSTRACT

A stool having a seat, a lower support member or support, and a post is described. The lower support member contacts the seat adjacent all or a portion of the periphery of the seat for providing support for the seat and a person seated on the seat. The lower support member may cover the bottom of the seat. The stool has both a post support mount or neck and a brace structure or collar for attaching the seat and lower support member to the post. The seat and lower support may be made of plastic. The stool may be part of a folding table having a tabletop and a frame supporting the tabletop and attached to the stool.

25 Claims, 7 Drawing Sheets

SEATING DEVICE HAVING A SUPPORT MEMBER

FIELD OF THE INVENTION

The present invention relates to a seating apparatus. More particularly, it relates to a seat supported by a seat post.

BACKGROUND

Typically, a stool seat may be supported by a single seat post attached to the center of the bottom of the seat and fixed to the ground, the floor of a building, or some other relatively stable or massive object. In particular, an institutional cafeteria-style table may include stool seating supported by vertical seat posts connected to a table frame. In one known arrangement, the seat post is inserted into a neck and secured to the neck by a bolt passing transversely through the neck and seat post.

However, it has been discovered that stool seats can fail due to repeated use, the weight of the seat occupants and abuse such as where the person on the seat repeatedly and aggressively attempts to rotate or twist the seat. The neck of the seat is particularly vulnerable to failure.

A need therefore exists for a more durable stool seat.

SUMMARY OF THE INVENTION

In one aspect of the invention, a seating device is provided. The seating device has a seat having a generally horizontal upper seating surface for supporting a person and may also have a downwardly extending rim along the periphery of the seat. The seating device has a lower support member for supporting the seat and contacting the seat adjacent at least a portion of or around the entire rim or periphery of the seat for providing support for the seat and a person seated on the seat. The seating device also has a generally vertically extending post support mount for securing a seat post on one of the seat and the lower support member. Additionally, the seating device may also have a generally vertically extending brace structure on the other of the seat and the lower support member. The brace structure, the post support mount and the seat post are matingly engageable to permit the brace structure, the post support mount and the seat post to be secured together. These elements may be secured together in any suitable manner, such as by a mechanical fastener, e.g., a nut and bolt, an adhesive or by any other suitable manner.

The brace structure, the post support mount and the seat post may be configured to partially nest within each other. For example, the seat post can be partially nested within the post support mount, which is partially nested within brace structure. The post support mount can be partially nested within the seat post and the seat post partially nested within the brace structure. Typically, the brace structure is matingly engageable with the support mount and securable with the support mount to the seat post.

In one embodiment, the lower support member substantially covers the bottom of the seat.

In another embodiment, the post support mount is on the bottom of the seat.

Typically, a substantially vertical extent of the post support mount has a non-circular cylindrical surface and the seat post can have a corresponding non-circular cylindrical surface at least where the seat post mates with the post support, to substantially prevent rotational movement of the seat relative to the seat post.

The brace structure may have a non-circular cylindrical surface that corresponds on opposed sides to the non-circular cylindrical surface of the post support mount. Typically, a generally horizontal aperture extends through the non-cylindrical surface of the post support and the brace structure to permit insertion of a bolt or other suitable fastener member, substantially horizontally through the post, the post support and the brace structure to secure the post to the post support and the brace structure. Preferably, the brace structure has two spaced apart generally vertically extending members. These vertically extending members each have the generally horizontal aperture. The brace structure may also be in the form of a collar.

In one embodiment, the seat also has a plurality of generally vertically disposed ribs extending from the bottom of the seating surface and extending radially typically from proximate the center of the seat to proximate the rim, and the lower support member contacts at least a portion of at least some of the ribs proximate to the rim. The seat may also have concentric ribs extending from the bottom of the seating surface.

The post support mount and the brace structure may be integral to the lower support member and the seat, respectively. Alternatively, they may be separate elements from one or both of the lower support member and the seat.

In another aspect of the invention, a seating apparatus for a person is provided. The apparatus has a seat, a lower support member for supporting the seat, and a post. The seat has an upper surface for sitting on, a rim extending downwardly along the periphery of the seat, and a downwardly extending neck for receiving the post. The lower support member has a downwardly extending collar, the collar at least partially covering the neck. The collar may be substantially frustoconical in shape. The lower support member is located below the seat and contacts the seat proximate to the rim for supporting the seat and the weight of the person. The post is attached to the seat and the lower support member and extends upwardly into the neck.

Typically, the seat also has a plurality of radial support ribs on the bottom of the seat. The lower support member typically contacts at least a portion of some of the radial support ribs. Typically, at least some and preferably all of the radial support ribs extend to the rim.

The lower support member may have a first support hole and a first support mounting surface through which the first support hole passes and the neck may have a first seat hole and a first seat mounting surface through which the first seat hole passes. The lower support member may be attached to the seat by a fastener located in the first support hole and the first seat hole, the first support mounting surface in contact with the first seat mounting surface and the first support mounting surface substantially conforming to the first seat mounting surface for transferring weight supported by the lower support member to the neck. Typically, the post has a first post hole and the fastener also passes through the first post hole. The post typically has a first post mounting surface through which the first post hole passes and the neck has a second mounting surface through which the first seat hole passes. The first post mounting surface may be in contact with the second seat mounting surface and can substantially conform to the first post mounting surface for transferring weight supported by the neck to the post. In one embodiment, the first support mounting surface and the first seat mounting surfaces are substantially flat. For providing additional strength, the seating apparatus advantageously may have a plurality of radial ribs of which one or more extends to the first seat mounting surface.

The collar may also have a second support hole and a second support mounting surface through which the second support hole passes and the neck also has a second seat hole and a second seat mounting surface through which the second seat hole passes. Also, the lower support member may be attached to the seat by a fastener located in the second support hole and the second seat hole and the second support mounting surface is in contact with the second seat mounting surface and the second support mounting surface substantially conforms to the second seat mounting surface for transferring weight supported by the support to the neck. The post may also have first and second post holes and the fastener passes through the first and second post holes.

In one embodiment, the lower support member has an upwardly extending support rim located internally of the seat rim. The support rim may contact the seat for providing support for the seat and the weight of the person.

In another aspect of the invention, a folding table is provided. It has a tabletop, a frame supporting the tabletop, and one or more of the inventive seating devices or stools as previously described herein suitably attached to the table, such as to the table frame, for example. The folding table may also have a plurality of non-rolling feet and a plurality of casters. Some of the feet or casters may be attached to the bottom of the seat posts to which the seats are attached.

DETAILED DESCRIPTION OF THE INVENTION

A durable and safe seating apparatus having a seat supported by a seat post is described in this section.

Figure 1:
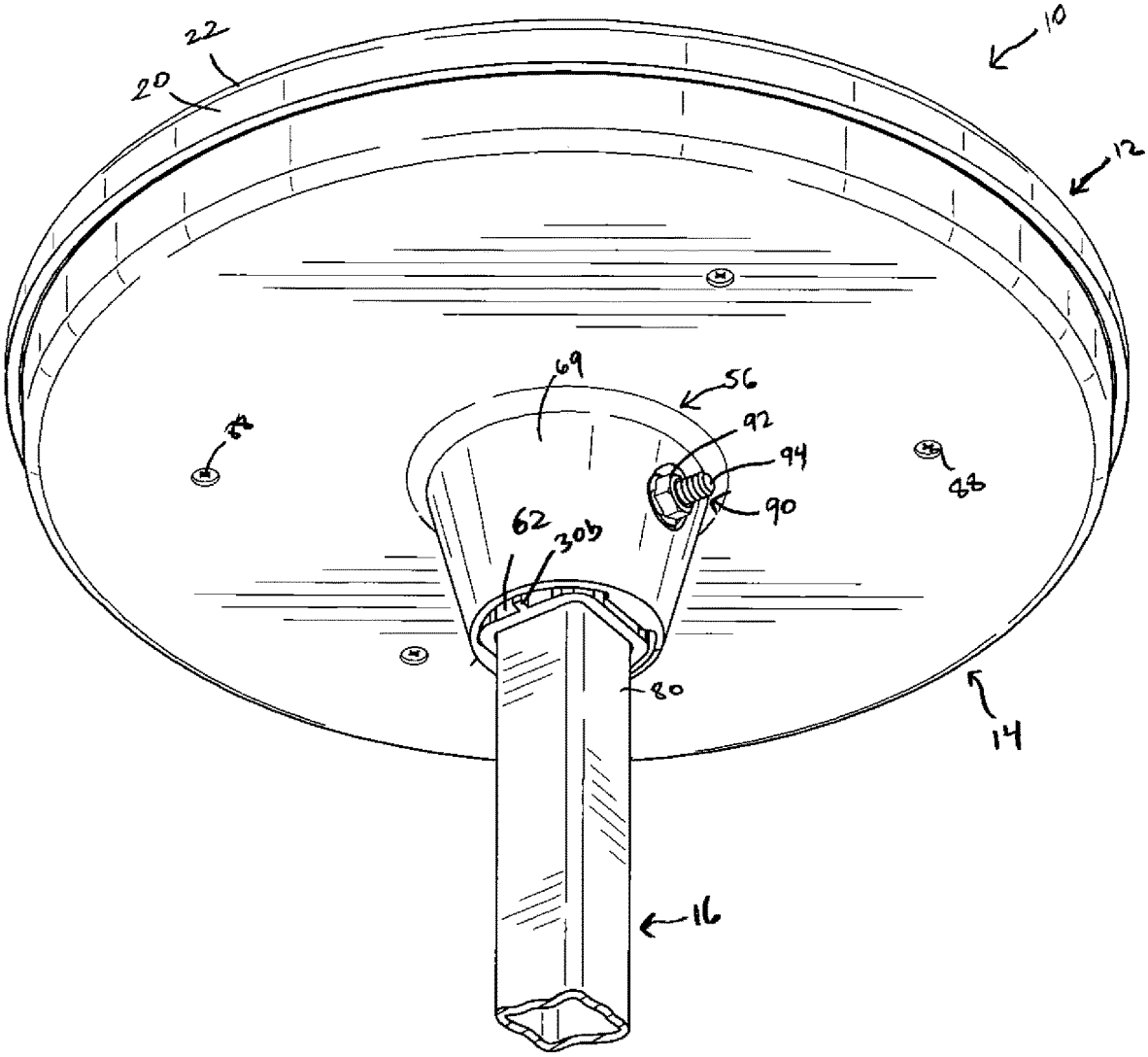
FIG. 1 is a perspective view of a seating device in accordance with one embodiment of the invention.
Figure 2:
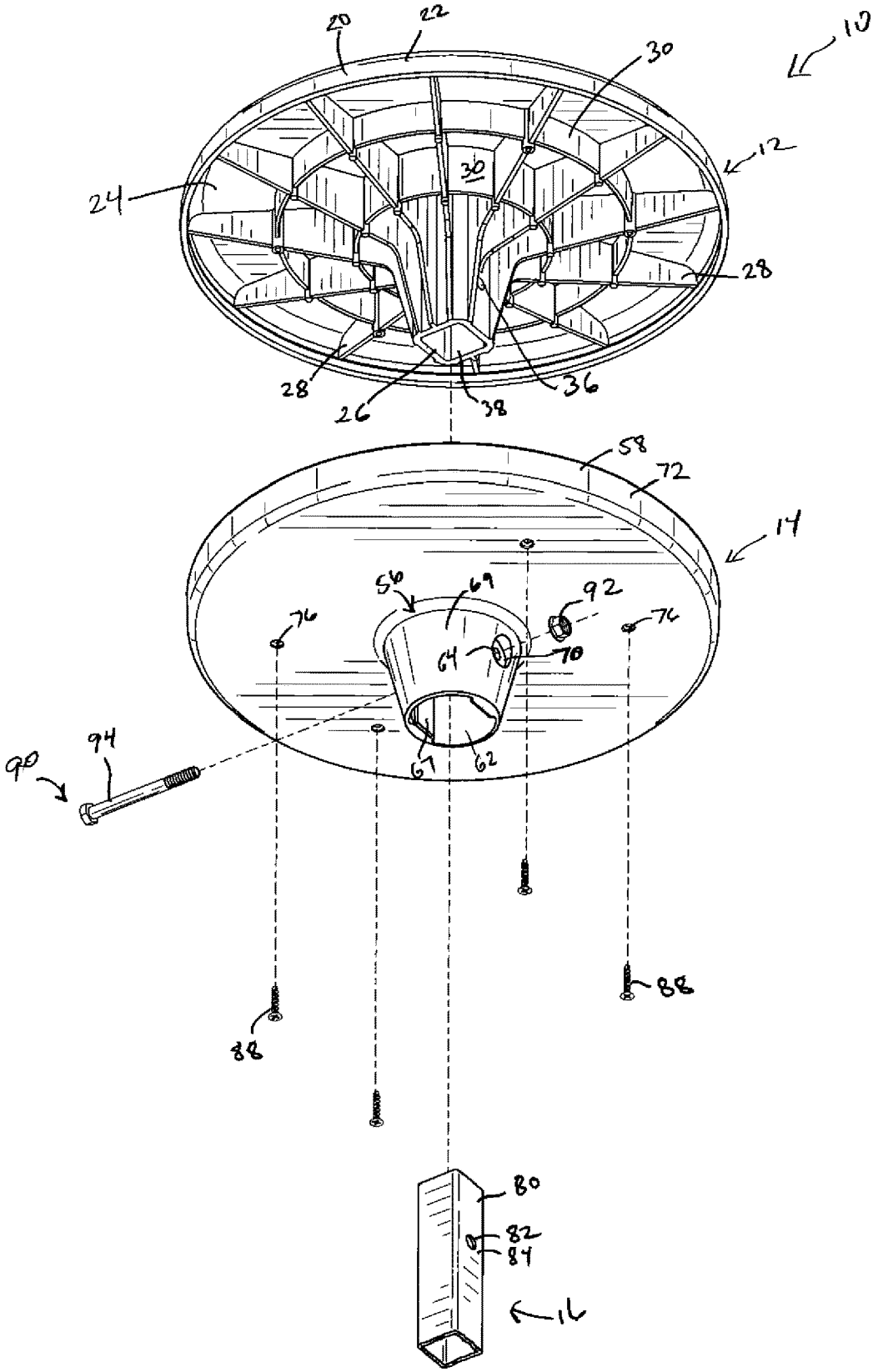
FIG. 2 is an exploded view from below of the seating device of FIG. 1.
Figure 3:
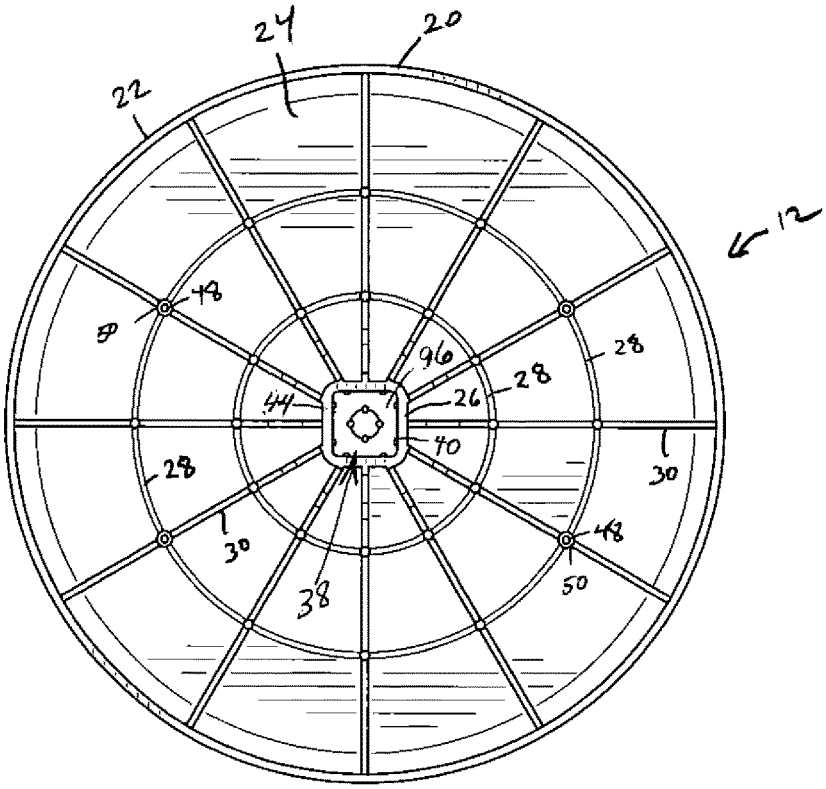
FIG. 3 is a bottom plan view of a seat portion of the seating device of FIG. 1.
Figure 4:
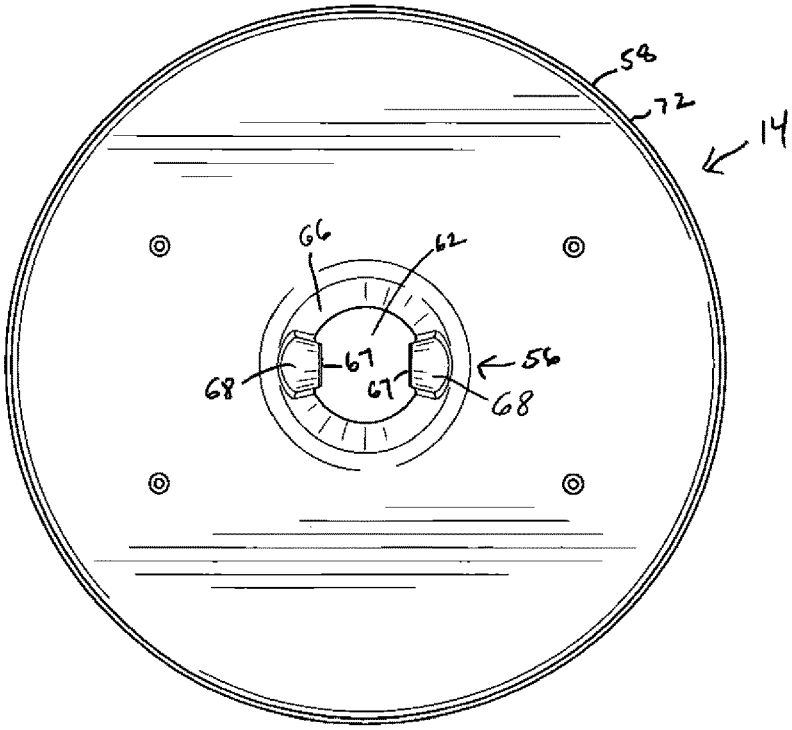
FIG. 4 is a top plan view of a support portion of the seating device of FIG. 1.

Referring to the Figures generally and in particular to FIGS. 1-5, 8 and 9, there is shown a seating device 10 in accordance with one embodiment of the present invention. As shown in FIG. 1, seating device 10 (which may be referred to herein as a stool) includes as major components a stool seat 12, a lower support member 14 (which may be referred to herein as a support) and a seat post 16, which are discussed individually below.

Figure 5:
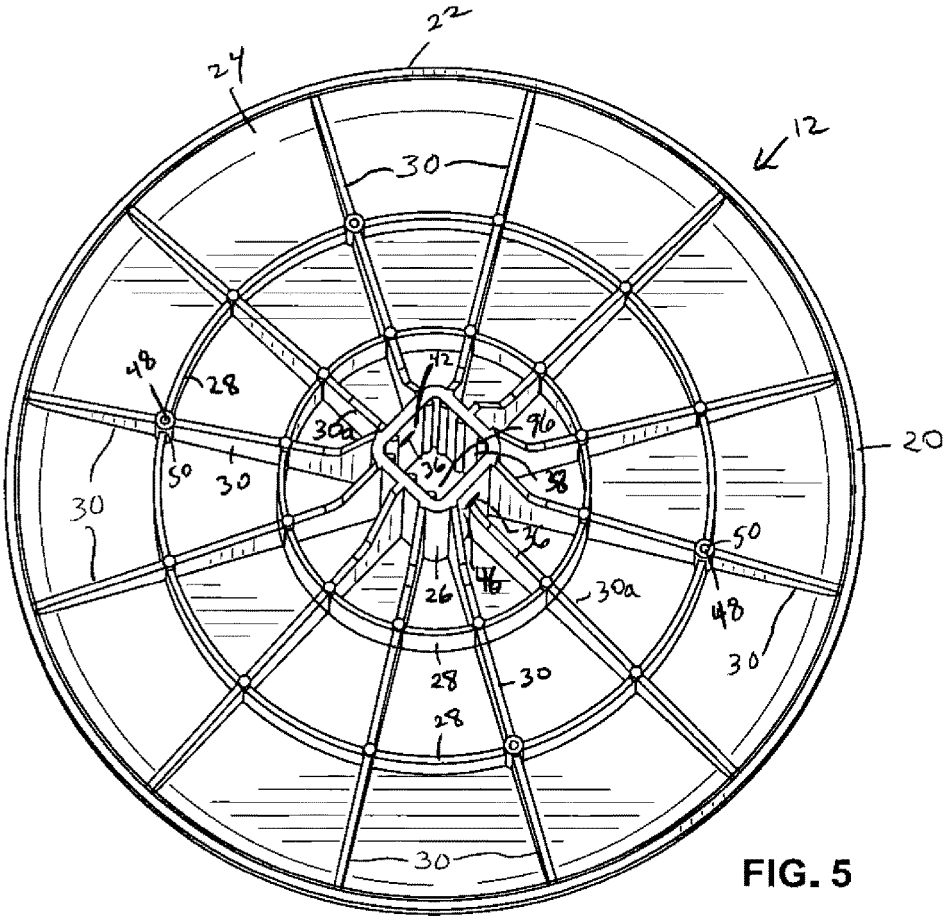
FIG. 5 is a perspective view of the bottom of the seat portion of FIG. 3.
Figure 6:
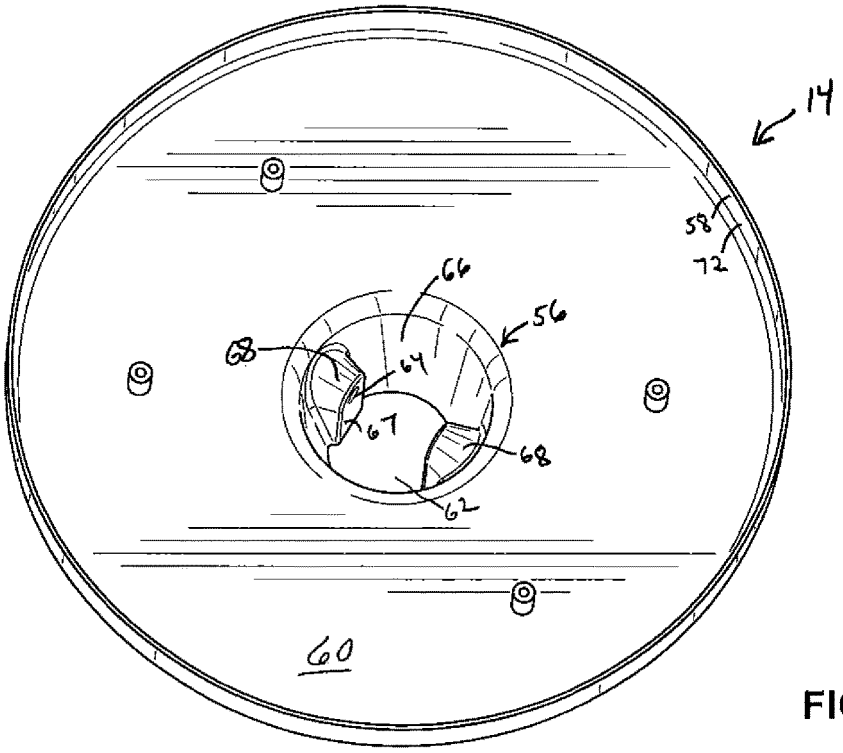
FIG. 6 is a perspective view of the top of the support portion of FIG. 4.
Figure 7:
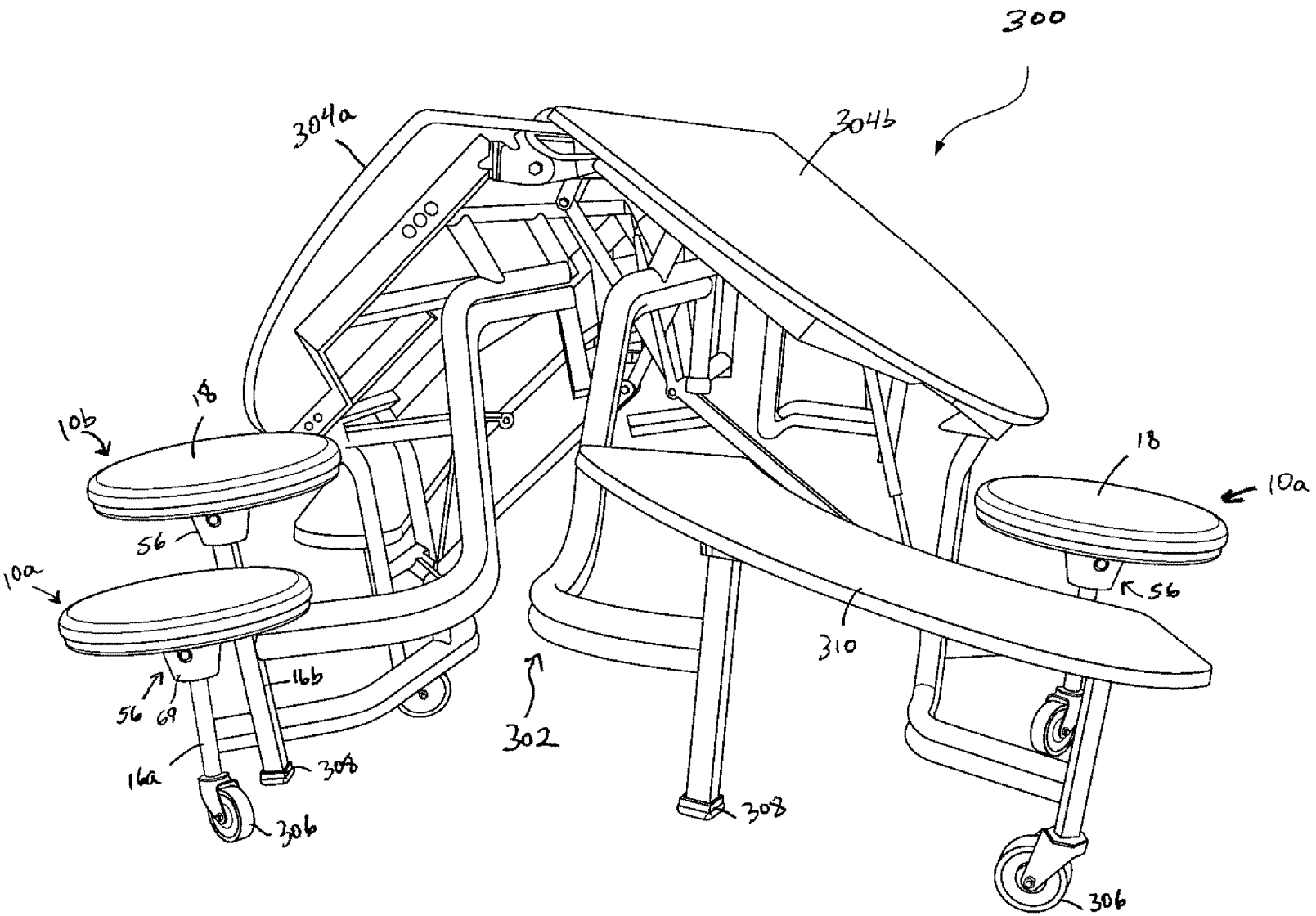
FIG. 7 is a perspective view of a folded table having several seating devices of FIG. 1, in accordance with a second embodiment of the invention.

Stool seat 12 has an upper surface 18 for sitting on (as seen in FIG. 7), a rim 20 along a periphery 22, an underside 24, and a generally vertically extending post support mount 26 (sometimes referred to herein as neck 26). Surface 18 is illustrated as being circular, but it may take any suitable or desired shape, whether a random shape or a regular geometric shape including, for example, square, trapezoidal, rectangular, triangular, cycloid and oval as shown in a co-owned and concurrently filed design application entitled STOOL having application Ser. No. 29/619,699, the disclosure of which is hereby incorporated by reference. Surface 18 is illustrated as being flat, but it may have any suitable contouring including a concave, convex or a more complex surface including, for example, as shown in the same design application. Rim 20 extends downwardly. It provides rigidity and strength to seat 12. Underside 24 has one or more concentric ribs 28 which may be as shown centered around post support mount 26 and a plurality of radial ribs 30. Ribs 30 extend from post support mount 26 to rim 20. Post support mount 26 is typically substantially centrally located relative to seat 12. Post support mount 26 typically has two opposed attachment or mounting holes 36 as illustrated in FIG. 5, and may include an additional pair or pairs of opposed holes angularly or vertically offset from illustrated holes 36, for attachment to support member 14 and seat post 16. Post support mount 26 has a bottom opening 38 for receiving post 16. Support mount 26 is shown as surrounding post 16 on four sides, but alternatively it could surround post 16 on two sides, typically opposed sides. Preferably ribs 30 include ribs 30*a*, which extend to the bottom of post support mount 26, and ribs 30*b*, which extend proximal attachment holes 36. Post support mount 26 allows seat 12 to be directly or indirectly attached to post 16; only direct attachment is shown in the Figures. Post support mount 26 has an interior surface 40 having one or more mounting surfaces 42 around a corresponding number of holes 36. Interior surface 40 preferably has a cross-section which preferably matches that of post 16, but such matching is not necessary to the invention. Post support mount 26 has an exterior surface 44 apart from ribs 30. The cross-section of exterior surface 44 may have any suitable shape including circular but is preferably non-circular and may be square. Surface 44 may be cylindrical or frustoconical, e.g., tapering towards bottom opening 38. Surface 44 has one or more mounting surfaces 46 around a corresponding number of holes 36. Underside 24 may also have a plurality of screw holes 48, preferably three or four, provided in the same number of associated bosses 50. Bosses 50 may be located at the junctions of radial ribs 30 and concentric ribs 28.

Support 14 has a brace structure 56, one or more ribs 58 and a support body 60. Brace 56 can be an integral part of support 14. This may typically be the case if support 14 is molded plastic, for example. Brace structure 56 has a bottom opening 62 for receiving post support mount 26 and one or more holes 64, preferably two or four, and most preferably one or two opposed pairs, for attachment to seat 12 and seat post 16. Brace structure 56 (which may be referred to herein as collar 56) has an interior surface 66 having one or more mounting surfaces 67 corresponding to mounting surfaces 46 around a corresponding number of holes 64. Mounting surfaces 67 and mounting surfaces 46 preferably have complementary shapes to improve the mating engagement of brace structure 56 and post support mount 26. Mounting surfaces 67 are provided on mounting blocks 68. Mounting blocks 68 reinforce brace structure 56. Brace structure 56 has an exterior surface 69. Exterior surface 69 need not match interior surface 66. Indeed, as illustrated exterior surface 69 has a circular cross-section which is part of a frustoconical surface and which matches the circular periphery 22 of seat 12. Brace structure 56 has recessed surfaces 70 around holes 64 for recessing a fastener. As illustrated brace structure 56 surrounds post 16 on four sides, but alternatively could surround post 16 on two sides. Brace structure 56 extends downwardly from body 60 while ribs 58 extend upwardly from body 60. As illustrated, support member 14 has a peripheral rib or rim 72 located at the periphery of support body 60. Support 14 may have additional ribs (not shown) for supporting seat 12. Such ribs could be radially or circularly oriented, including as illustrated with respect to ribs 28 and 30 of stool seat 12. Support body 60 also has vertical holes 76 aligned with screw holes 48 of seat 12.

Seat post 16 is dimensioned for insertion into post support mount 26. Seat post 16 has an exterior surface 80 and one or more attachment holes 82 corresponding to holes 36 and holes 64. Surface 80 has mounting surfaces 84 around holes 82. Post 16 may have any suitable cross-sectional shape including circular and non-circular including square.

Figure 8:
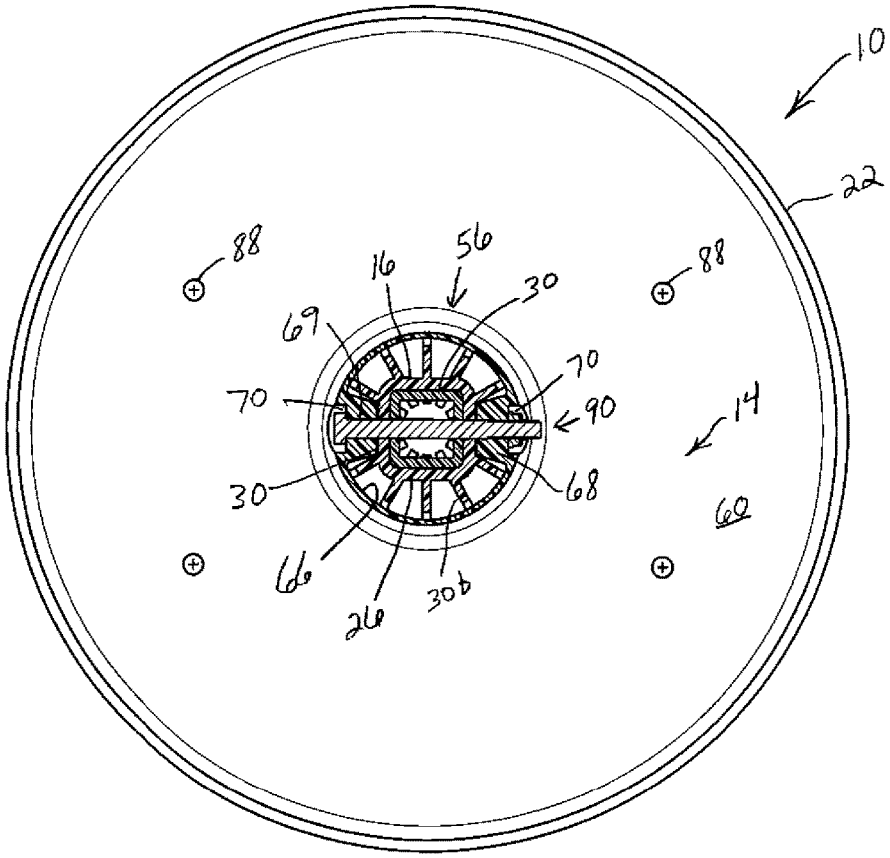
FIG. 8 is a horizontal cross-sectional view of the seating device through the center of bolt 94 of FIG. 1.
Figure 9:
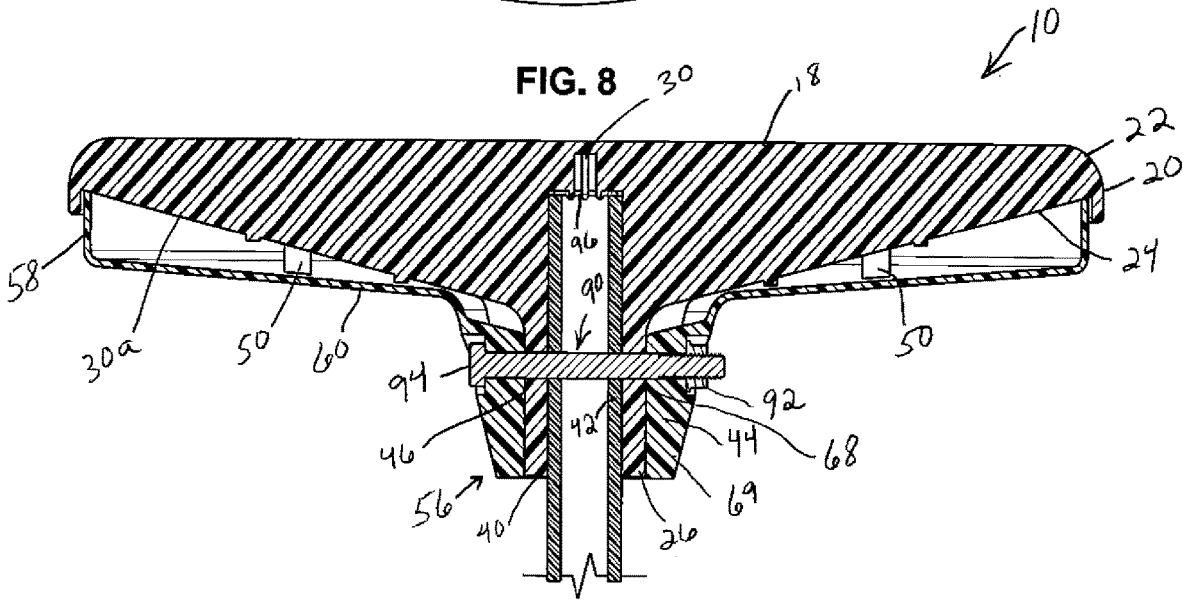
FIG. 9 is a cross-sectional view of the seating device of FIG. 1 along a vertical plane through the center of bolt 94.

Seating device 10 and its assembly will now be discussed as a whole, including as shown in FIGS. 8 and 9. Seating device 10 has screws 88 and fastener 90. Screws 88 attach support member 14 to seat 12 and are screwed into screw holes 48. Fastener 90 may be any suitable fastener including screws, rivets and a nut 92 and a bolt 94. As illustrated in FIGS. 1-4 and 8-9, seat support member 14 is directly attached to post 16, post 16 is inserted into post support mount 26 and post support mount 26 is inserted into brace structure 56 so that holes 36 align with holes 64 and 82. Ribs 30 on either side of respective attachment holes 36 in cooperation with mounting blocks 68 guide mounting surfaces 46 and mounting surfaces 67 into alignment making assembly easier.

Fastener 90 is inserted through each of these holes 36, 64 and 82. Preferably, holes 36, 64 and 82 are provided as one or two opposed pairs so that a single fastener passes through a pair of holes 36, 64 and 82 as illustrated.

Seating device 10 once fully assembled provides improved support and durability compared to prior stools. In particular, support member 14 contacts underside 24 of seat 12 proximal to rim 20 to provide support to seat 12. More specifically, upwardly extending rim 72 contacts underside 24 at radial ribs 30. Alternatively, support member 14 could be dished more such that rim 72 need not be upwardly extending. In another alternative, rib 58 could be located inwardly and proximal to support the periphery and contact underside 24. As will be explained, the various mounting surfaces transfer the weight supported by support member 14 to post 16. Fastener 90 urges or clamps one or two mounting surfaces 84 of support member 14 against one or two mounting surfaces 46 thereby creating frictional engagement between these surfaces and transferring the weight supported by support member 14 to post support mount 26. In turn, fastener 90 urges or clamps one or two mounting surfaces 42 of post support mount 26 against one or two mounting surfaces 84 of post 16 thereby creating frictional engagement between these surfaces and transferring the weight supported by post support mount 26 to post 16.

As previously described, some of the load from a person or occupant located on seat 12 is transferred to support member 14 to post 16 through support mount 26. Preferably, seat post 16 also directly or indirectly contacts underside 24 of seat 12 thereby transferring some of a stool occupant's weight from seat 12 to post 16 without passing through post support mount 26. For example, stool 10 may have a metal spacer 96 shown in FIG. 9 (metal spacer is omitted from FIG. 8 for clarity and shown in FIG. 3) between underside 24 and top of post 16 to prevent damage to seat 12 by the top of post 16 if post 16 is hollow.

In addition to providing support, support member 14 covers underside 24 of seat 12 providing a cleaner look. Support 14 also provides customization options because seat 12 and support member 14 can be the same or different color to better match a purchaser's preference or school colors.

Additionally, recessed surfaces 70 of brace structure 56 permit fastener 90 to be recessed making it more difficult for vandals and pranksters without a socket wrench to loosen fastener 90.

Seat 12 and support member 14 are typically made of a suitable plastic including ABS. They may be made by any suitable molding technique including injection molding. Seat post 16 is typically made of a suitable metal such as steel tubing.

Figure 10:
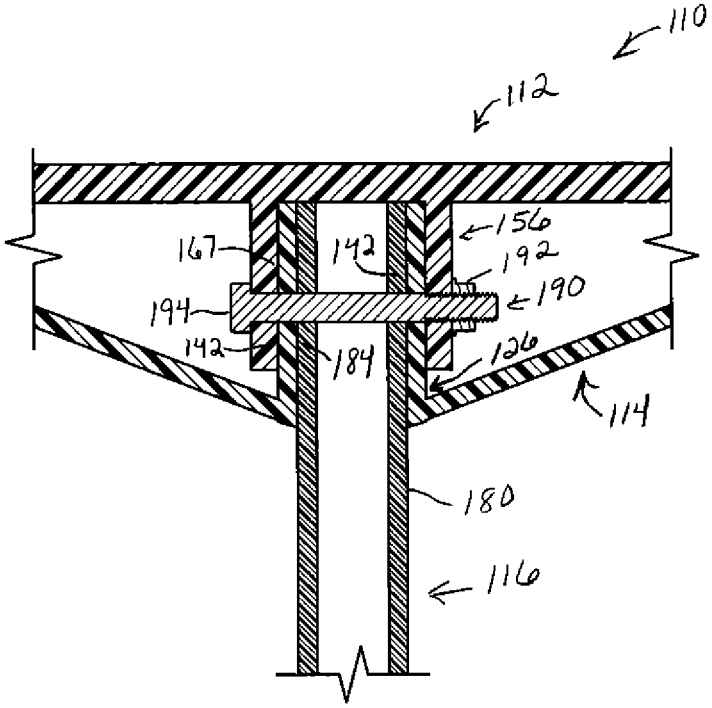
FIG. 10 is a vertical cross-sectional view of a portion of a seating device, in accordance with another embodiment of the invention, through the center of the seating device.

Turning to FIG. 10, there is shown a seating device 110 (also referred to herein as stool 110) in accordance with another embodiment of the present invention. Stool 110 is similar to stool 10. In particular, stool 110 has the same or similar components as stool 10 except as discussed herein. When components are the same or similar between the two stools, the components are denoted with reference numerals that differ by 100.

Stool 110 has as major components a stool seat 112, a support member 114 (which may be referred to herein as a support) and a seat post 116. Seat 112 has a brace structure 156 while support member 114 has post support mount 126 that accepts post 180 therein. Brace structure 156 has mounting surfaces 167 while post support mount 126 has mounting surfaces 142. Post 116 has mounting surfaces 184. Brace structure 156 is urged against post support mount 126, which is urged against seat post 116 by a fastener 190 (illustrated as a nut 192 and a bolt 194). Fastener 190 matingly engages mounting surfaces 167 to mounting surfaces 142 and mounting surfaces 142 to mounting surfaces 184. Suitable access ports (not shown) may be provided to allow easy insertion of fastener 190 and assembly.

Figure 11:
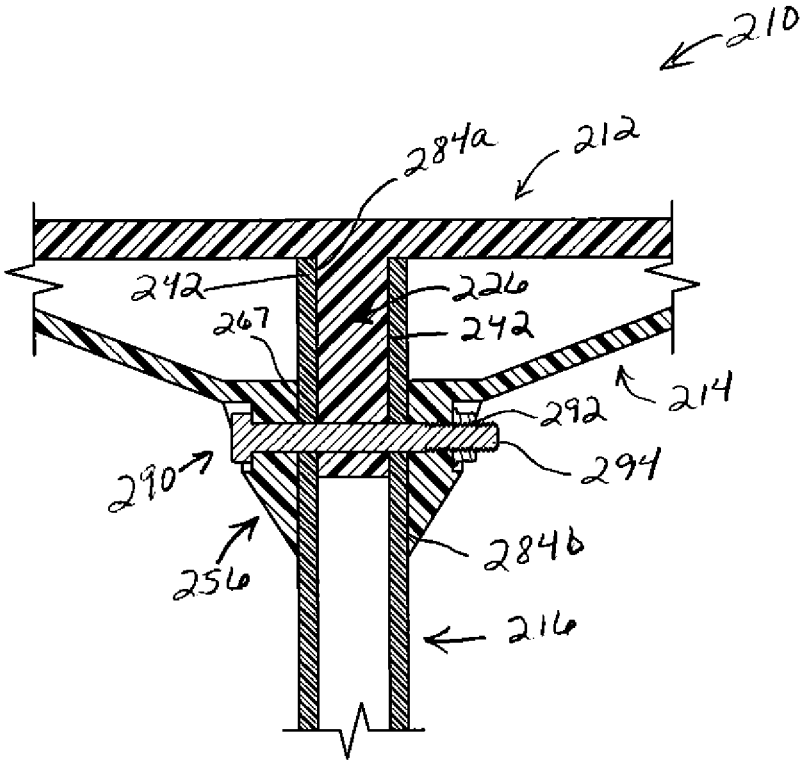
FIG. 11 is a vertical cross-sectional view of a portion of a seating device, in accordance with still another embodiment of the invention, through the center of the seating device.

Turning to FIG. 11, there is shown a seating device 210 (referred herein as stool 210) in accordance with still another embodiment of the present invention. Stool 210 is similar to stool 10 and stool 110. In particular, stool 210 has the same or similar components as stool 10 and stool 110 except as discussed herein. When components are the same or similar between the stools, the components are denoted with item numerals that differ by 100 or 200.

Stool 210 has as major components a stool seat 212, a support member 214 (which may be referred herein as a support) and a seat post 216. Seat 212 has a post support mount 226 while support member 214 has a brace structure 256. Brace structure 256 has mounting surfaces 267 while post support mount 226 has mounting surfaces 242. Post 216 has internal mounting surfaces **284*a* and external surface mounting surfaces 284*b*. Brace structure 256 is urged against post 216 by fastener 290 (illustrated as a nut 292 and a bolt 294). Post support mount 226 is inserted into post 216 and is secured by fastener 290. Fastener 290 matingly engages mounting surfaces 267 to mounting surfaces 284*b*. Mounting surfaces 242 are matingly engaged with mounting surfaces 284*a* by any suitable structure including making post support mount 226 a tight fit in post 216**.

Turning to FIG. 7, a folding table 300 incorporating stool seats in accordance with the invention is provided having a frame 302, a tabletop 304, a plurality of casters 306, a plurality of feet 308 and optionally one or more benches 310. Table 300 is illustrated in a folded position in which casters 306 are against the ground, feet 308 are raised off the ground, and tabletop 304 is folded into halves 304*a* and 304*b*; in the unfolded position both casters 306 and feet 308 are against the ground provided the ground is level and tabletop 304 is unfolded. Folding table 300 also has one or more stools 10, 110 or 210. As illustrated in FIG. 7, the stools are stools 10. Stools 10 may include at least one stool 10*a*, which has a caster 306 at the bottom of post 16*a*, and at least one stool 10*b*, which has a non-rolling foot 308 at the bottom of post 16*b*. Stools 110 and 210 may also be provided with casters 306 or feet 308.

While the invention has been described with respect to certain embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A seating device comprising:

a seat having a periphery and generally horizontal upper seating surface for supporting a person;

a lower support member for supporting the seat and contacting the seat adjacent at least a portion of the periphery for providing support for the seat and a person seated on the seat;

a generally vertically extending post support mount on the seat for securing a seat post and a generally vertically extending brace structure on the lower support member;

the brace structure, the post support mount and the seat post being matingly engageable and secured together.

2. The seating device of claim 1, wherein the lower support member substantially covers the bottom of the seat.

3. The seating device of claim 1, wherein the post support mount is on the bottom of the seat and the seat further comprises a downwardly extending rim along the periphery of the seat and the lower support member contacts the seat adjacent the rim.

4. The seating device of claim 3, wherein a substantially vertical extent of the post support mount has a non-circular cylindrical surface.

5. The seating device of claim 1, wherein the brace structure has a non-circular cylindrical surface that corresponds on opposed sides to the non-circular cylindrical surface of the post support mount.

6. The seating device of claim 5, wherein a generally horizontal aperture extends through the non-cylindrical surface of the post support and the brace structure to permit insertion of a bolt substantially horizontally through the post, the post support mount and the brace structure to secure the post to the post support mount and the brace structure.

7. The seating device of claim 6, wherein the brace structure comprises two spaced apart generally vertically extending members.

8. The seating device of claim 7, wherein the brace structure is a collar.

9. The seating device of claim 1, wherein the seat further comprises a plurality of generally vertically disposed ribs extending radially proximate to the periphery and the lower support member contacts at least a portion of some of the ribs proximate to the periphery.

10. A seating apparatus for a person, the apparatus comprising:

a seat having an upper surface for sitting on, a rim extending downwardly along the periphery of the seat, and a downwardly extending neck for receiving a post;

a lower support member for supporting the seat having a downwardly extending collar, the collar at least partially covering the neck, the lower support member located below the seat and contacting the seat proximate to the rim for supporting the seat and the weight of the person; and a post attached to the seat and the lower support member, the post extending upwardly into the neck.

11. The seating apparatus of claim 10, wherein the seat further comprises a plurality of radial support ribs on the bottom of the seat.

12. The seating apparatus of claim 11, wherein the lower support member contacts at least a portion of some of the radial support ribs.

13. The seating apparatus of claim 12, wherein at least some of the radial support ribs extend to the rim.

14. The seating apparatus of claim 10, wherein the lower support member has a first support hole and a first support mounting surface through which the first support hole passes and the neck has a first seat hole and a first seat mounting surface through which the first seat hole passes, the lower support member attached to the seat by a fastener located in the first support hole and the first seat hole, the first support mounting surface in contact with the first seat mounting surface and the first support mounting surface substantially conforming to the first seat mounting surface for transferring weight supported by the lower support member to the neck.

15. The seating apparatus of claim 14, wherein the post comprises a first post hole, the fastener also passing through the first post hole.

16. The seating apparatus of claim 15, wherein the post has a first post mounting surface through which the first post hole passes and the neck has a second mounting surface through which the first seat hole passes, the first post mounting surface in contact with the second seat mounting surface and substantially conforming to the first post mounting surface for transferring weight supported by the neck to the post.

17. The seating apparatus of claim 16, wherein the first support mounting surface and the first seat mounting surfaces are substantially flat.

18. The seating apparatus of claim 17, wherein the collar is substantially frustoconical.

19. The seating apparatus of claim 14, further comprising a plurality of radial ribs, at least one radial rib extending to the first seat mounting surface.

20. The seating apparatus of claim 14, wherein the collar further comprises a second support hole and a second support mounting surface through which the second support hole passes and the neck further comprises a second seat hole and a second seat mounting surface through which the second seat hole passes, the lower support member attached to the seat by a fastener located in the second support hole and the second seat hole, the second support mounting surface in contact with the second seat mounting surface and the second support mounting surface substantially conforming to the second seat mounting surface for transferring weight supported by the support to the neck.

21. The seating apparatus of claim 20, wherein the post comprises first and second post holes, the fastener also passing through the first and second post holes.

22. The seating apparatus of claim 10, wherein the lower support member comprises an upwardly extending support rim, the support rim located internally of the seat rim.

23. The seating apparatus of claim 22, wherein the support rim contacts the seat for supporting the seat and the weight of the person.

24. A folding table apparatus comprising:

a tabletop;

a frame supporting the tabletop; and a stool attached to the frame, the stool comprising a seat having a generally horizontal upper seating surface for supporting a person and a downwardly extending rim along the periphery of the seat, a lower support member for supporting the seat and contacting the seat adjacent the rim for providing support for the seat and a person seated on the seat, and a generally vertically extending post support mount on the seat for securing a seat post and a generally vertically extending brace structure on the lower support member;

the brace structure, the support mount and the seat post being matingly engageable and secured together.

25. A folding table apparatus comprising:

a tabletop;

a frame supporting the tabletop; and a stool attached to the frame, the stool comprising a seat having a generally horizontal upper seating surface for supporting a person and a downwardly extending rim along the periphery of the seat, a lower support member for supporting the seat and contacting the seat adjacent the rim for providing support for the seat and a person seated on the seat, and a generally vertically extending post support mount on the lower support member for securing a seat post and a generally vertically extending brace structure on the seat;

the brace structure, the support mount and the seat post being matingly engageable and secured together.

* * * * *